US006442842B1

(12) United States Patent
Parry et al.

(10) Patent No.: US 6,442,842 B1
(45) Date of Patent: Sep. 3, 2002

(54) VACUUM ASSISTED HAIR CUTTER

(76) Inventors: Michael J. Parry, 7 West Street, Farnham Surrey (GB), GU9 7 DN; Ernest G. Stewart, 6339 Nancy Ridge Rd., San Diego, CA (US) 92121

( * ) Notice: Subject to any disclaimer, the term of this patent is extended or adjusted under 35 U.S.C. 154(b) by 0 days.

(21) Appl. No.: 09/686,540

(22) Filed: Oct. 11, 2000

Related U.S. Application Data

(63) Continuation-in-part of application No. 09/130,909, filed on Aug. 7, 1998, which is a continuation-in-part of application No. 08/670,548, filed on Jun. 27, 1996, now abandoned, which is a continuation-in-part of application No. 08/387,475, filed on Feb. 13, 1995, now abandoned.

(51) Int. Cl.[7] ..... B26B 19/44

(52) U.S. Cl. ..... 30/133; 30/201

(58) Field of Search ..... 30/133, 200, 201, 30/41.5, 41.6

(56) References Cited

U.S. PATENT DOCUMENTS 4,005,526 A * 2/1977 Clay ..... 30/133
5,704,128 A * 1/1998 Lin ..... 30/201 X

* cited by examiner

*Primary Examiner*—Douglas D. Watts
(74) *Attorney, Agent, or Firm*—Thomas J. Tighe

(57) ABSTRACT

A hair cutting device is connected to a vacuum source to draw hair into a cutting chamber and includes a mechanism for cutting which allows an operator to both position the cutting device and to activate the cutting mechanism with one hand. The cutting mechanism includes two blades and preferably at least one blade slidably moves against the other to cut hair. The cutting mechanism also maintains the blades in proper position and applies pressure to at least one of the blades to ensure the proper cutting of the hair. Preferably non-parallel cutting edges and the bowing of at least one of the blades act to provide an effective moving shear point between the blades. The cutting mechanism also allows for continued airflow through the cutting chamber regardless of the position of the blades during the cutting operation.

18 Claims, 13 Drawing Sheets

VACUUM ASSISTED HAIR CUTTER

This is a continuation-in-part application of my pending U.S. patent application Ser. No. 09/130,909 filed Aug. 7, 1998, and continued under 37 CFR §1.53(d) entitled "VACUUM HAIR CUTTER" which was a continuation-in-part application of my U.S. patent application Ser. No. 08/670,548 filed Jun. 27, 1996, abandoned and continued under 37 CFR §1.53(d) Jun. 26, 1998, entitled "VACUUM HAIR CUTTER" which was a continuation-in-part application of my U.S. patent application Ser. No. 08/387,475 filed Feb. 13, 1995, entitled "VACUUM ASSIST FOR HAIR CUTTING", now abandoned.

This invention relates generally to a hair cutting apparatus, and more particularly to a mechanism for cutting hair and pneumatically removing the cut hair.

As background material, U.S. Pat. No. 4,679,322 and U.S. patent application Ser. No. 08/387,475 filed Feb. 13, 1995, and 08/670,548 filed Jun. 27, 1996, are incorporated herein by reference.

BACKGROUND OF THE INVENTION

Prior art hair cutting devices which incorporate a vacuum to remove cut hair include scissors or electric shears incorporated in a housing. The scissors and/or electric shears cut hair as it is being drawn into the housing by a vacuum. Examples of such devices are illustrated in U.S. Pat. Nos. 3,900,949; 4,473,945 and 4,679,322. An alternative arrangement is illustrated in U.S. Pat. No. 4,000,562 wherein a vacuum source is applied to an individual's scalp and slots are incorporated in the vacuum source for scissors to cut the hair. Although these prior arrangements dispose of the cut hair, they have many disadvantages. A major disadvantage is that two hands are required to position the cutting apparatus on an individual's scalp and to cut the hair. The use of two hands makes the cutting operation more difficult and does not give the operator a free hand to steady a cuttee's head, or to comb or otherwise prepare a section of the hair while simultaneously cutting another section. Many of the prior art devices also do not incorporate an adequate vacuum sealing arrangement to insure that a proper vacuum is applied to the hair and to further prevent the hair from straying from the cutting zone. Prior art devices also suffer from back pressure flow problems during operation due to the hair inlet being blocked at times, the improper cutting or uneven cutting of the hair during operation and/or inadvertent tangling or pulling of the hair from the scalp of the individual during cutting. Such operations are unsatisfactory and painful to the individual. Electric cutters similar to ones illustrated in U.S. Pat. No. 4,679,322 are also heavy and very bulky due to the need for an electric motor and room for the complicated blade movement arrangement.

In view of the numerous disadvantages associated with prior art vacuum-assisted cutting devices, there has developed a need for a light-weight vacuum-assisted cutting device which can easily and effectively cut hair, can be positioned on an individual's scalp and actuated by a single hand of an operator, and has a simple yet effective cutting mechanism. This invention satisfies the need.

Other advantages and attributes will be readily discernible upon a reading of the text hereinafter.

SUMMARY OF THE INVENTION

An object of the present invention is to provide a device for cutting hair which can be easily operated with a single hand, can easily and effectively cut an individual's hair and can conveniently remove the cut hair from the cutting chamber.

Another object of the present invention is to provide a device for cutting hair which includes a vacuum source for drawing the hair from the cutting chamber.

Yet another object of the present invention is to provide a device for cutting hair which insures that the cutting blades are properly positioned when cutting an individual's hair.

Still yet another object of the present invention is to provide a cutting mechanism which includes blades which lie in a cutting plane that is substantially perpendicular to the plane in which the hair is drawn into a cutting chamber.

Another object of the present invention is to provide a cutting mechanism wherein the blade edges of the blades are designed to cut hair in a guillotine fashion.

Still yet another object of the present invention is to provide a cutting mechanism which applies pressure to the blades which is preferably perpendicular, but can be at some other angle, to the cutting plane of the blades to insure that the blade edges are closely adjacent during the cutting of the hair.

Another object of the present invention is to provide a cutting mechanism wherein at least one blade has a bowed cutting edge angled with respect to the other blade which results in the cutting edges of each blade making shearing contact at a point which travels along the edges.

An additional object of the present invention is to provide a cutting mechanism wherein the airflow through the device aids in maintaining a positive shearing contact between the blades during the cutting action.

An additional object of the present invention is to provide a cutting mechanism wherein the airflow through the device is maintained regardless of the position of the blades during the cutting action.

Yet another object of the present invention is to provide an opening in the device for cutting which controls the amount of hair drawn into the cutting chamber to facilitate in the proper operation of the cutting device.

Another object of the present invention is to provide a device for cutting which includes a spacing mechanism for adjusting the length of hair to be cut.

In accordance with yet another feature of the present invention, the cutting mechanism includes at least two cutting blades. At least one of which is slidably moveable between an open position and a shear position. Preferably, the two blades are disposed within the cutting chamber in a plane which is substantially perpendicular to the plane in which the hair is being vacuum drawn into the chamber. This provides for an easier and more complete shearing of the hair. In the open position, the hair is drawn into the cutting chamber and between the cutting edges of the two blades. As the blades are moved toward the shear position, the hair disposed between the two blades is cut by the blades. The cut hair is then drawn through the hollow outlet body and into a disposal chamber of the vacuum source. Preferably, one of the blades is substantially affixed in a single position in the cutting chamber and the second blade is slidably moveable between the open position and the shear position. In the open position, the cutting edge of one blade is preferably spaced from the cutting edge of the second blade. When the hair is to be cut, at least one blade is drawn and/or pushed toward the second blade. This type of cutting arrangement greatly simplifies the design of the cutting arrangement and reduces the jamming or freezing of the blades during cutting since the blade edges completely separate after cutting as opposed to a constant blade overlapping design which is susceptible to jamming. The blade movement mechanism preferably directly applies the blade movement force. Indirect blade movement force arrangements such as those that incorporate a cam to move one or more blades significantly complicate the cutting arrangement, applying large indirect forces which are typically perpendicular to the plane of the movement of the blade thus making the blades more susceptible to damage and more susceptible to jamming. By directly drawing one blade toward another blade, only the needed force to cut the hair is applied to the blade. Such an arrangement greatly simplifies the design, operation and effectiveness of the cutting mechanism. Preferably, the two blades are biased in the open position and require the operator to manually activate the cutting mechanism to move the blades into the shear position. The blades can be biased in the open position by a spring or other resilient mechanism. The edges of the two blades may be designed so that they are not parallel, i.e. an edge is angled with respect to the other edge, so as to resemble a guillotine cutting arrangement. Such a blade edge design facilitates in the ease and efficiency of the cutting of the hair when the blades are moved into the shear position.

In accordance with yet another aspect of the present invention, the cutting chamber includes a pressure arrangement for applying pressure to at least one of the cutting blades. Preferably, the pressure applied is substantially perpendicular to the plane of movement of the blades between the open and shear positions. The applied pressure prevents the blades from separating as they move from the open position to the shear position. Unintended separation of the blades during cutting can result in uncut or miscut hair. The pressure arrangement may also be designed to allow the blades to slightly separate when cutting a large volume of hair and/or relatively thick hair to increase the ease and effectiveness of cutting large volumes of hair and/or very thick hair. The pressure arrangement preferably includes one or more springs and a pressure frame. The springs are preferably positioned to cause the pressure frame to be biased against one or more of the cutting blades. This spring arrangement both directs pressure to the blades and further allows the blades to slightly separate as described above. In a first embodiment, several springs are used in the pressure arrangement so that the pressure applied to the blades by the pressure frame is substantially uniform during the operation of the cutting mechanism. An alternate pressure arrangement uses resilient pads instead of springs to apply pressure to the pressure frame.

In accordance with still yet another aspect of the present invention, a blade guide is incorporated in the cutting mechanism to insure that the blades properly move between the open position and the shear position. The blade guide preferably limits the movement of the blades in a slot when the blades slide between the open position and the shear position. Preferably, the blade guide substantially affixes one of the cutting blades into a single position and provides a slot arrangement for the second blade to slide between the open and shear position. The slot arrangement also preferably allows the cutting edges of the two blades to slightly separate as they close together so that large volumes of hair and/or thick hair can be easily and effectively cut.

In accordance with another aspect of the present invention, at least one of the cutting blades includes a blade extension which extends between the two blades in both the open and shear position. The blade extension insures that when the blades move together, the cutting edges of the two blades do not abut against one another thus interfering with the cutting of the hair between the blades. As can be appreciated, other arrangements can be used to insure the proper position of the blades during the movement between the open position and the shear position.

In still yet another aspect of the present invention, at least one blade is bowed along the length of its edge. The bowed blade design ensures that the cutting edges of the blades meet at a shearing point which moves progressively along the edges as the blades close together.

In accordance with another aspect of the present invention, a slotted opening which includes at least one rake is connected to the opening of the inlet section. Preferably, two or more rakes are connected to the slotted opening. The rakes are preferably attached to and/or positioned adjacent to the slotted opening. The rakes and the slotted opening receive a defined volume of hair and direct such hair through the inlet section opening and into the cutting chamber. The slotted opening is preferably disposed to draw hair into the cutting chamber substantially perpendicular to the cutting plane of the blades. This alignment of the slot opening improves the ease and effectiveness of cutting hair, but it can be appreciated that the slotted opening can be positioned to direct hair into the cutting chamber angled to the cutting plane. The rakes are designed to comb the hair as the cutting device is moved on an individual's head. The combing of the hair helps separate tangled hair so that the hair will be properly drawn into the cutting chamber. The rakes are preferably positioned substantially parallel to one another. The rakes extend from the slotted opening a distance which is sufficient to position the device on an individual's head to provide sufficient spacing for air flow into the slotted opening. By providing sufficient air flow into the slotted opening while the cutting device is positioned on an individual's head, the problems associated with static airflow in the cutting chamber and increased load on the vacuum source due to airflow blockage are essentially eliminated. It can be appreciated that additional air passageways can be incorporated into the cutting device to further prevent airflow blockage. It can be further appreciated that the rake surfaces can be curved to facilitate the movement of the rakes through an individual's hair and to further ensure that air properly flows into the slotted opening.

In accordance with still yet another aspect of the present invention, a spacing device is connected between the slotted opening and the inlet opening. The spacing device allows the operator to cut the hair of an individual at a desired length. A longer spacer results in an individual having longer hair after the haircut whereas a shorter spacer results in shorter hair. The spacing device preferably has a cross-sectional shape which is substantially similar to the cross-sectional shape of the slotted opening and the inlet opening; however, it can be appreciated that the spacing device can have other cross-sectional shapes. The spacing device preferably is a substantially straight tubular device which does not alter the course of the hair entering into the slotted opening and extending into the cutting chamber; however, the spacing device may be angularly shaped.

The spacing device may include corrugated ribs to allow the spacing device to be easily adjustable between an angular and straight position to facilitate in the positioning of the cutting device during the cutting of an individual's hair.

In accordance with yet another aspect of the present invention, the manual mechanism for operating the cutting mechanism includes a squeeze lever to the outlet body. The squeeze lever is preferably biased in the open position so that when the operator is not grasping the squeeze lever, the blades of the cutting mechanism are in the open position.

When the squeeze lever is pivotally drawn toward the outlet section, it causes the blades of the cutting mechanism to move together to cut hair. As can be appreciated, the squeeze lever may be alternatively attached to a switch which activates and/or de-activates an electrical motor or the like that moves the blades.

These and other objects and advantages, expressed or implied, hereinafter are accomplished by a device for cutting hair which includes a cutting chamber is connected between an inlet section and an outlet section. The outlet section is connected to a vacuum source which creates a vacuum at the outlet section and causes air to be drawn into an opening in the inlet section. The air drawn into the inlet opening causes hair on an individual's scalp to be drawn into the cutting chamber when the device is placed upon the head of an individual. Disposed in the cutting chamber is a cutting mechanism which cuts the hair being vacuum drawn into the cutting chamber. The cutting mechanism is preferably manually operated; however, it can be appreciated that the cutting mechanism may be operated by an electric motor or the like. The outlet section preferably includes an elongated hollow body which an operator can easily grasp to position the device at a desired area on an individual's head. The cutting mechanism is manually activated by a switch or lever which is preferably located adjacent the grasping portion of the outlet body so that the operator can simultaneously position the cutting device and activate the cutting mechanism with a single hand.

DESCRIPTION OF THE PREFERRED EMBODIMENTS

Figure 1:
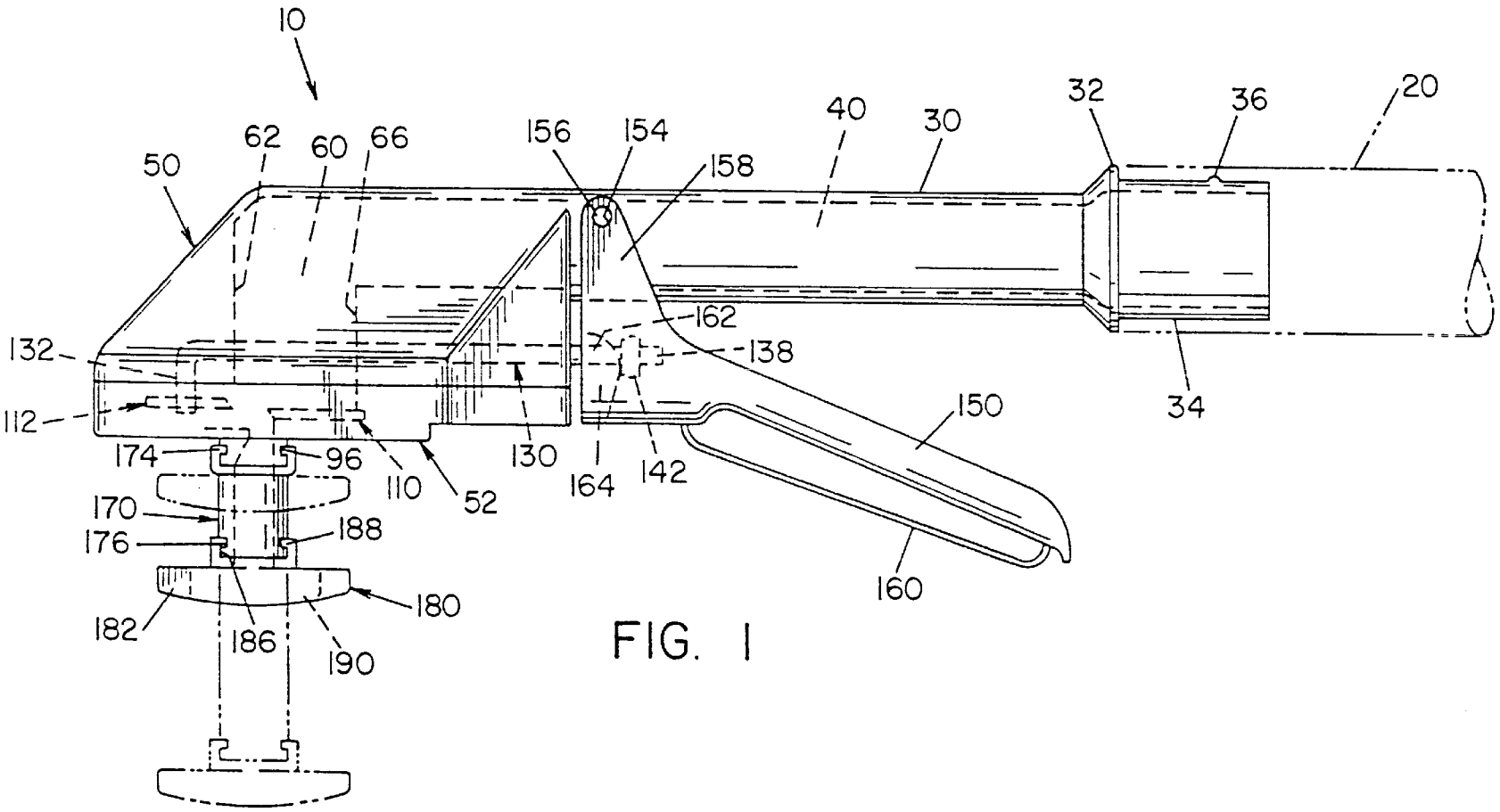
FIG. 1 is a side elevation view of a first embodiment of the present invention.
Figure 2:
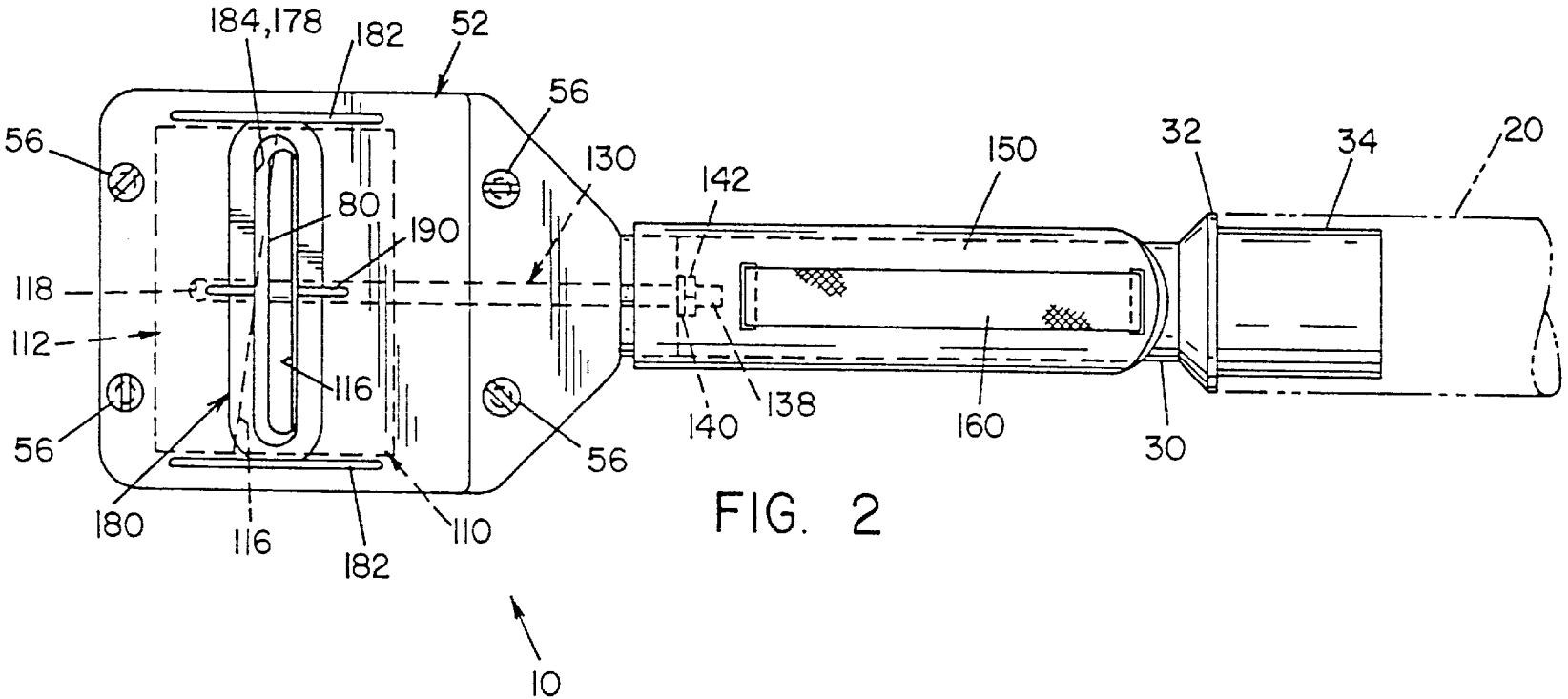
FIG. 2 is a bottom view of the cutting device of FIG. 1.
Figure 3:
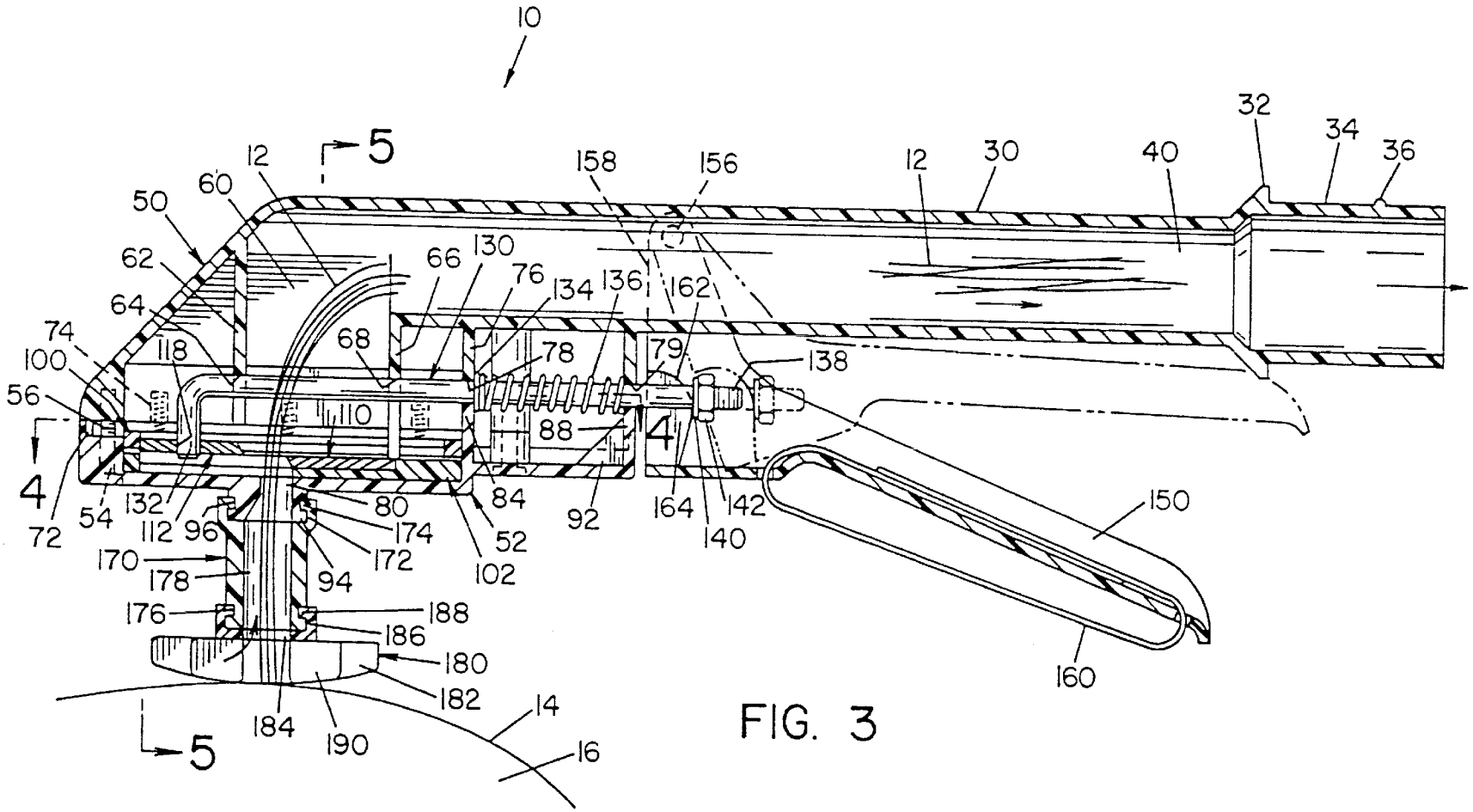
FIG. 3 is a cross-sectional view of the cutting device as shown in FIG. 1.

Referring to the drawings which are for the purpose of illustrating the preferred embodiments of the invention only and not for the purpose of limiting the same, FIGS. 1–3 illustrate a cutting device 10 for vacuum cutting an individual's hair 12. Cutting device 10 incorporates an outlet section which includes an outlet body 30 which is connected between a cutting housing top 50 and a vacuum hose 20. Outlet body 30 preferably is cylindrical and includes a vacuum channel 40 which runs the length of the outlet body. At the end of the outlet body distal from the housing top is an outlet flange 32, an outlet extension 34 and a connection rib 36. The outlet extension telescopically inserts into the vacuum hose 20. At least one connection rib 36 is positioned on the exterior of outlet extension 34 and is used to help secure the outlet extension in the vacuum hose 20. Outlet flange 32 contacts and covers the face of vacuum hose 20.

Figure 7:
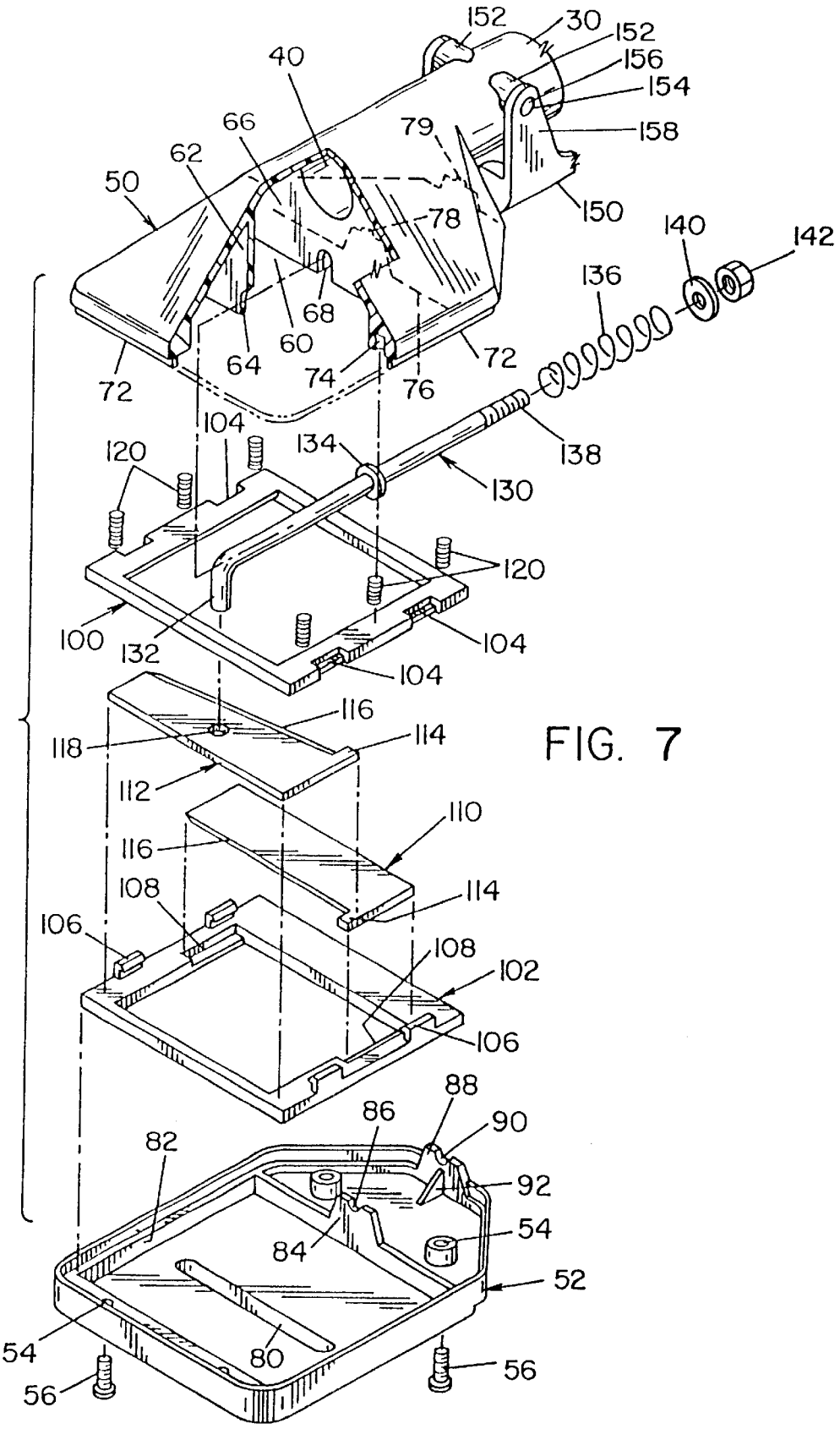
FIG. 7 is an exploded view of the cutting chamber and components positioned therein of FIG. 1.
Figure 8:
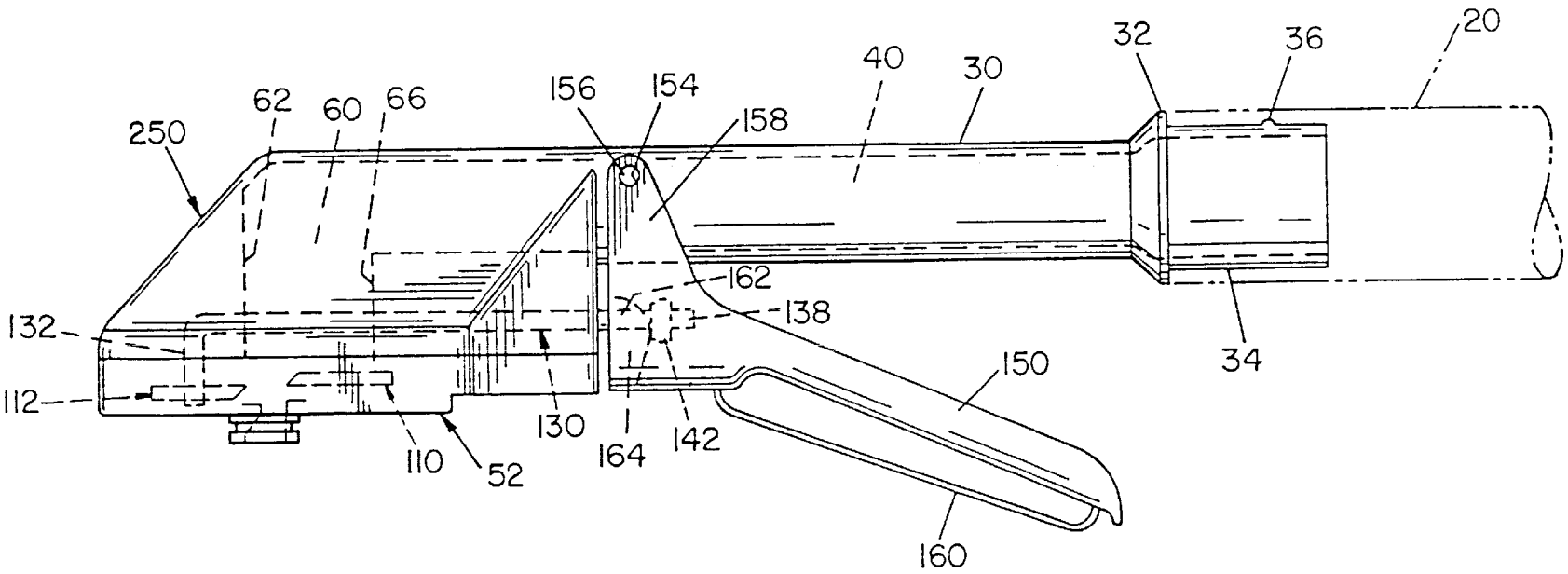
FIG. 8 is a side elevation view of a second embodiment.
Figure 9:
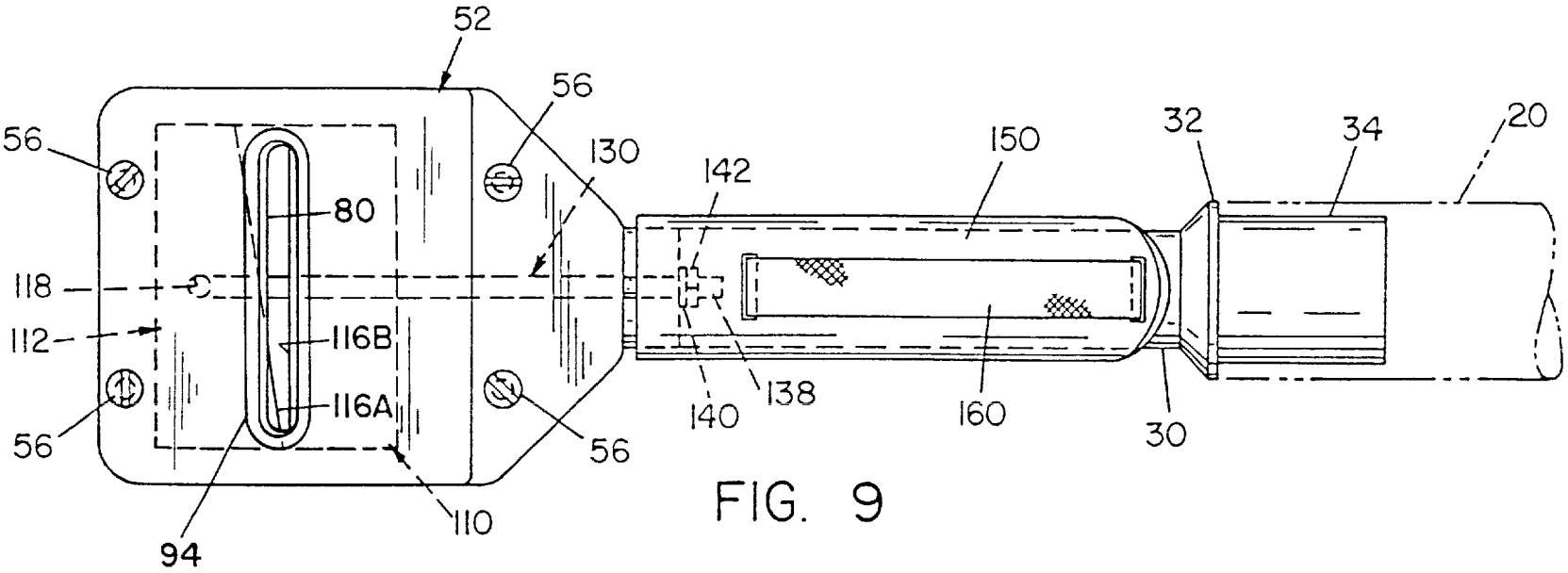
FIG. 9 is a bottom view of the cutting device of FIG. 8.
Figure 10:
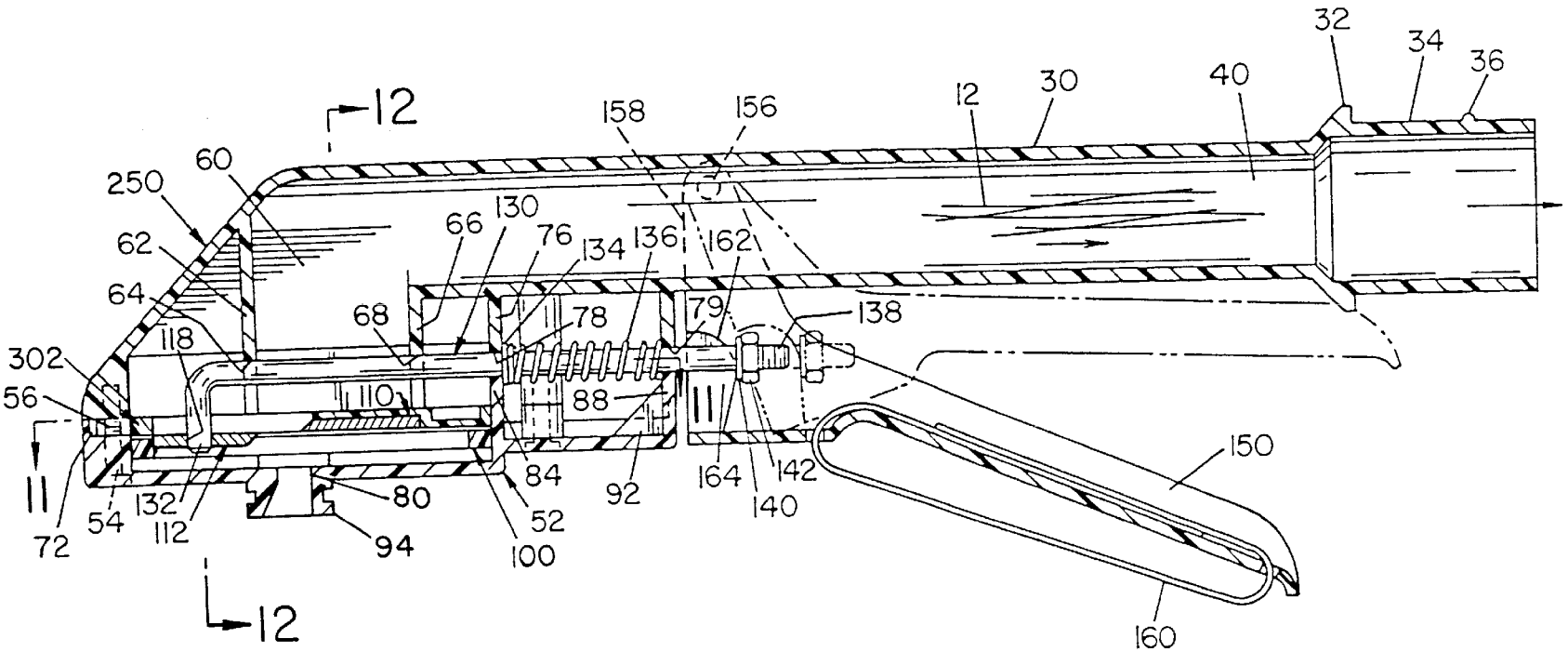
FIG. 10 is a cross-sectional view of the cutting device as shown in FIG. 8.
Figure 11:
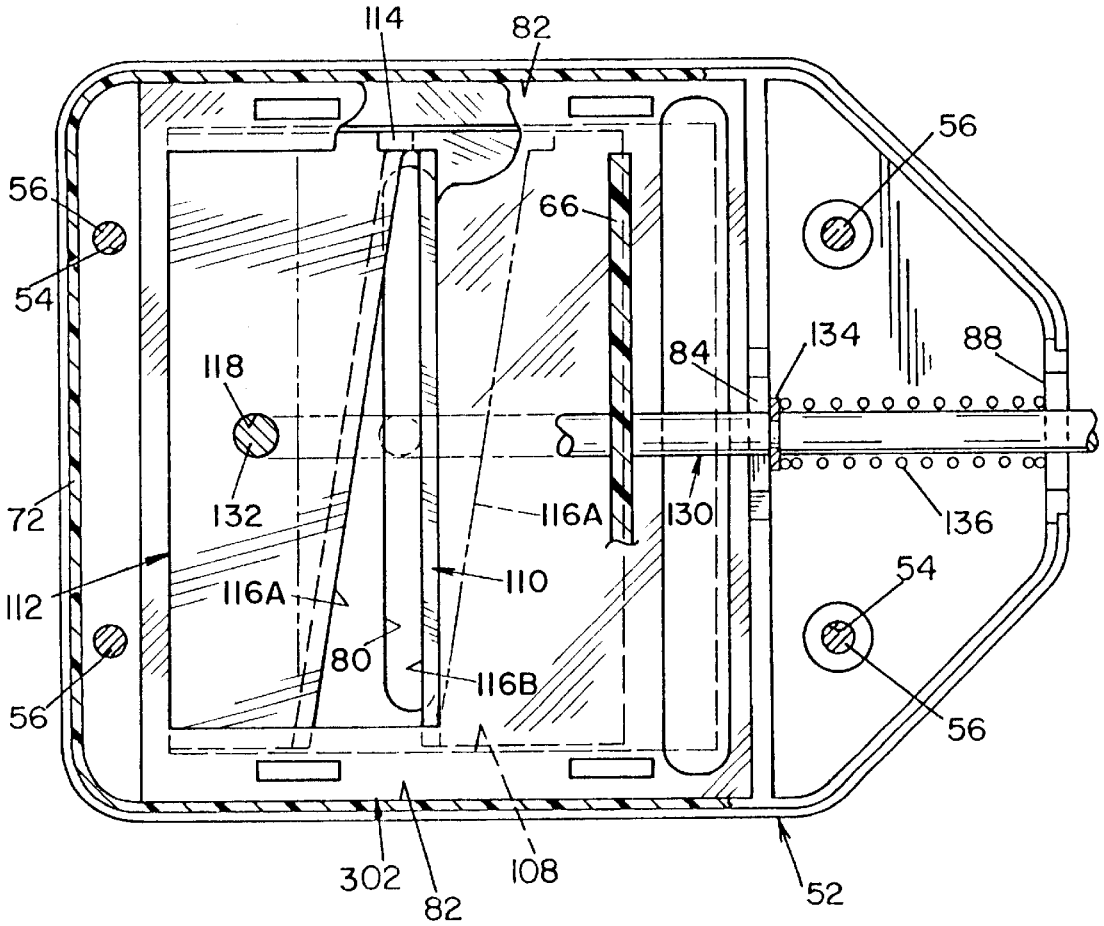
FIG. 11 is a cross-sectional view of the cutting device taken along line 11—11 of FIG. 10.

Referring to FIGS. 1, 3 and 7, the cutting housing includes the top 50 and a base 52, and several housing screw holes 54 to receive housing screws 56 for affixing the top and base together. Top 50 defines a cutting chamber 60 between a front partition wall 62 and a rear partition wall 66. Both of the partition walls include a partition slot 64, 68 to guide a segment of a blade rod 130. Positioned about the base of cutting housing top 50 is a housing ridge 72 which inserts into housing base 52 to seal the two housing sections. Also positioned about the base of top 50 are several spring recesses 74 each of which receive a blade guide spring 120. Housing top 50 further includes a blade rod partition 76 rearwardly spaced from rear partition wall 66. Blade rod partition 76 includes a partition slot 78 which receives front blade rod support 84 located on housing base 52. Positioned at the rear base of housing top 50 is a rear housing slot 79 which receives rear blade rod support 88 positioned on housing base 52. Housing base 52 includes an opening 80 to receive hair 12 into the cutting chamber 60. Housing base 52 also includes a blade guide wall 82 to receive a set frame (as described below) 102. Positioned on the rear wall of blade guide wall 82 is front blade rod support 84. Rod support 84 includes a rod slot 86 to support and guide a blade actuating rod 130. Positioned rearwardly from rod support 84 is a rear rod support 88. Rear rod support 88 includes a rod slot 90 which functions similarly as blade slot 86. Both rod supports 84,88 preferably include a support reinforcement tab 92 to rigidify and strengthen the two rod supports.

Referring again to FIGS. 1, 3 and 7, a blade guide includes a pressure frame 100 and the set frame 102. The frame 102 seats in guide wall 82. Both the pressure frame 100 and set frame 102 define a central opening, 101 and 103 respectively, to allow hair to pass therethrough. Set frame 102 includes a blade slot 108 which receives and rigidly secures in position a set blade 110. Clips 106 extending normally from the set frame 102 hook respective notches 104 defined along the lateral edges of the pressure frame 100. The Clips 106 also accurately locate the pressure frame 100 which guides the movement of shear blade 112 when it is moved. The height of the clips 106 allows the shear blade 112 to freely move between the open position and the shear position, and allows the blade edges to slightly separate when the blades are moved into the shear position. Shear blade 112 includes cutting edge 116A that is preferably angled with respect to the cutting edge 116B of set blade 110 with both blades having overlapping extensions 114. Though not shown, the shear blade is longitudinally bowed. Shear blade 112 includes a hole 118 to receive an elbowed end 132 of the blade actuating rod 130. The rod also includes an opposite, threaded end 138. Between the elbow and threaded end there is a rod flange 134, and restricted at its other end by the rear rod support 88. The threaded end receives a rod spring 136 which is restricted at one end by rod flange 134. Washer 140 is inserted into the rod following the spring and is retained thereon either by the rear rod support 88 or by nut 142 which is threaded onto thread end 138.

Referring now to FIGS. 1, 3, 5, and 7, a handle 150 is pivotally connected to the front portion of outlet body 30 and preferably has a loop strap 160. Handle 150 includes two handle flanges 158 each defining a mount slot 154. Mount slots 154 receive a pivot pin 156 inserted through handle mount 152, which in turn is connected to outlet body 30. In the front of handle 150 is a rod slot 162 which receives the threaded end of blade rod 130. As illustrated in FIG. 3, the threaded end of blade rod 130 is inserted into rod slot 162 until the threaded end is completely passed through rod nut abutment 164 of handle 150. Blade rod 130 is then connected to handle 150 by applying the rod nut 142 onto the threaded end.

Referring now to FIGS. 1, 2, 3 and 5, a spacer 170 is attached to base opening extension 94 of the housing base 52. Spacer 170 includes a top spacer slot 172 and a top spacer tab 174 which slides onto and connects to extension groove 96 of base opening extension 94. This connection also provides an essentially vacuum tight seal between the spacer and base housing opening. Spacer 170 defines a hollow passageway 178 which extends therethrough. The cross-sectional shape of the passageway is preferably substantially the same as the cross-sectional shape of base housing opening 80. At the bottom of spacer 170, is a slot 176 which receives a platform body 180. This connection produces an essentially vacuum tight seal between the spacer and platform body. Platform body 180 includes a platform slot 186 and platform tab 188 which fits into the slot 176. At the base of platform body 180 are two side ribs 182 and one or more rake ribs 190 between the two side ribs. The ribs 182, 190 are profiled to follow smoothly over the scalp 14 of the individual 16. The platform body also includes an opening 184 which has a cross-sectional shape which is substantially the same as the cross-sectional shape of spacer passageway 178. As can be appreciated, the spacer can be eliminated and the platform body can be directly attached to the base opening extension.

Figure 6:
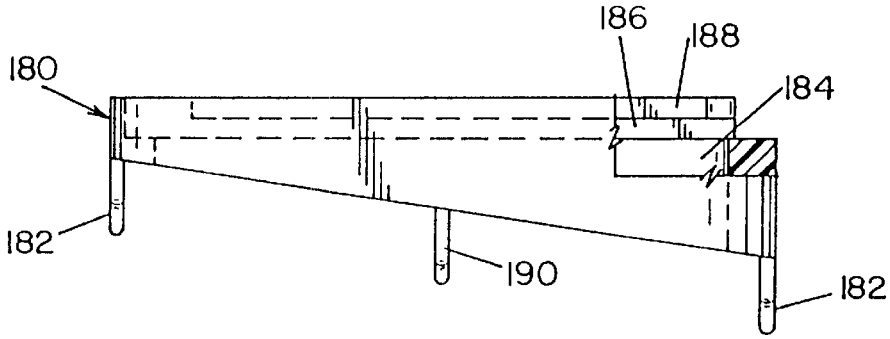
FIG. 6 is front view illustrating an angular spacer attachment.

Referring now to FIG. 6, illustrated is an alternative embodiment of the platform body 180 wherein the side ribs 182 and rake rib 190 extend at differing distances from the platform tab 188 end of the platform body. As can be appreciated, other designs of the bottom of the platform body may be incorporated.

Referring to FIG. 7, blades 110 and 112 can be easily replaced by removing the housing screws to separate base 52 from top 50. The blade guide pressure and set frames 100, 102 are then removed. The two frames can then be easily unsnapped from each other so that new blades can be substituted into the blade guide. Once the blades are replaced, the housing is re-assembled.

Figure 4:
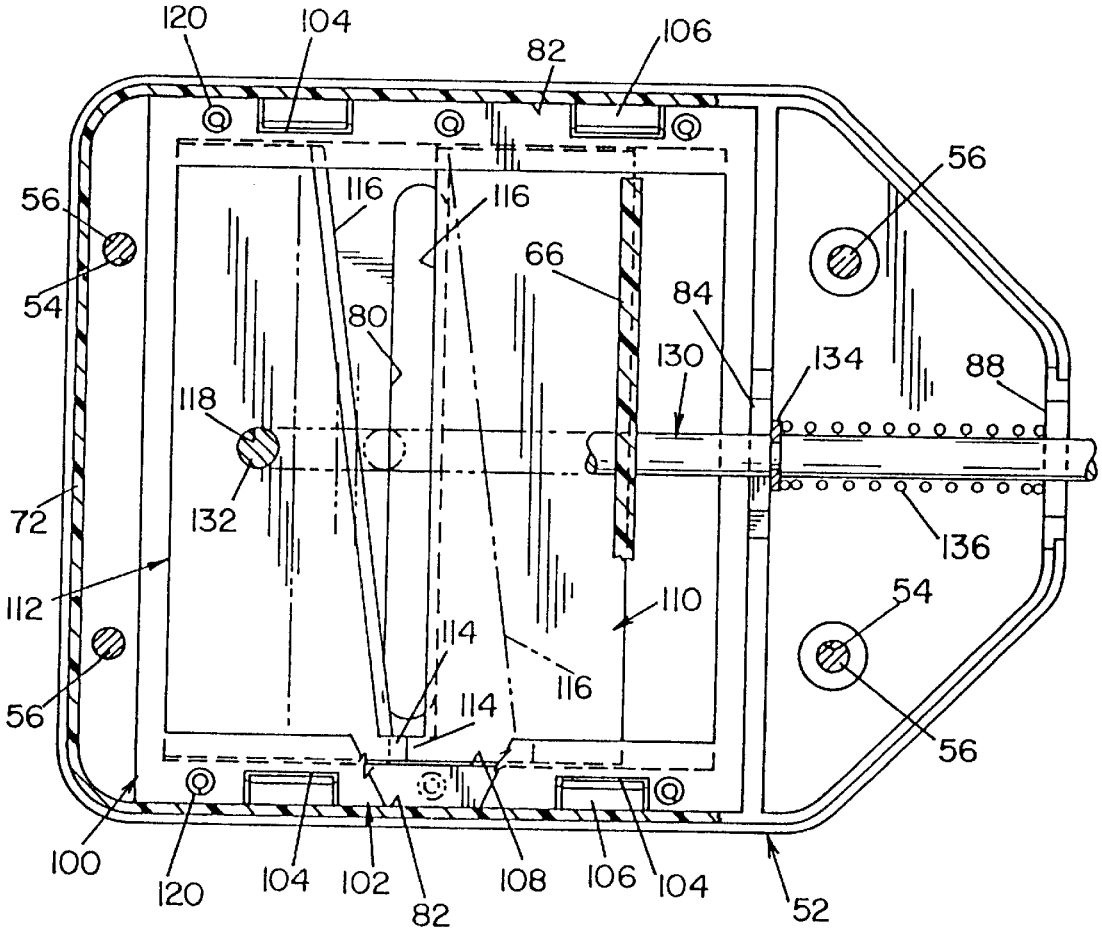
FIG. 4 is a cross-sectional view of the cutting device taken along line 4—4 of FIG. 3.

To operate the cutting device, the vacuum source is activated which draws air through the platform body 180 and spacer 170, and into the cutting chamber 60. The drawn air causes hair to be drawn into cutting chamber. As best illustrated in FIG. 3, the vacuum drawn hair passes between set blade 110 and shear blade 112 when the two blades are in the open position. The hair between the blades is cut by an operator drawing handle 150 toward outlet body 30. The drawing of the handle causes blade rod 130 to move rearwardly which in turn causes the cutting edge of shear blade 112 to move toward the cutting edge of set blade 110. Blade rod 130 is held in position and guided during movement by front and rear rod slot 86, 90, partition slot 78, rear housing slot 79 and rear partition slot 68. As shown in FIGS. 3 and 4, the movement of shear blade into the shear position closes the space between the two blades and results in the blade edges cutting any hair extending between them. The shear blade edge acts similar to a guillotine when cutting the hair. The cut hair is drawn through cutting chamber 60 and into vacuum passageway 40 as shown in FIG. 3. The hair in vacuum passageway 40 proceeds through vacuum hose 20 and into a hair disposal bin.

The cutting of the hair is facilitated by two special designs in the cutting device. As shown in FIGS. 4 and 7, shear blade 112 has a cutting edge 116A which is angled with respect to the cutting edge 116B of set blade 110. This orientation of blade edge 116A of shear blade 112 results in the hair being cut at different times as shear blade 112 is moved toward set blade 110. In other words, the shear point moves along the edges. This results in more efficient and easier cutting than if the two cutting edges where parallel. The bowed edge of shear blade 112 keeps the cutting edges in closed contact at the shear point as it moves along. This combination of the guillotine blade design with the bowed blade design easily, efficiently, and effectively cuts the hair between the two blades without causing the hair to mat or lay down during cutting. Furthermore, the pressure frame 100 applies pressure to shear blade 112 as it moves to keep the two blades closely adjacent. However, the spring biasing of the pressure frame also allows shear blade 112 to slightly lift away from set blade 110 when they are cutting a large amount of hair and/or very thick hair. These special features significantly improve the ease and effectiveness of cutting hair.

Once a cut has been made, the operator releases handle 150 which then moves back into its open position. The handle is biased in its open position because rod spring 136 is between rod flange 134 and the inner face of rear blade rod support 88. In such an arrangement, the drawing of the handle causes the blade rod to move rearwardly and cause the rod spring to be compressed between the rod flange and blade rod support 88. The release of the handle results in the rod spring moving the rod flange forward which in turn causes the handle to move into the open position. The movement of handle 150 back into the open position causes shear blade 112 to move into its open position to allow additional hair to be cut.

The sealing of the cutting chamber to ensure that a proper vacuum is achieved between vacuum passageway 40 and base housing opening 80 is accomplished by several components incorporated in housing top 50 and housing base 52. The peripheral edge of the housing is substantially vacuum sealed by top ridge 72 abutting against the inner side surface of the housing base. The heads of housing screws 56 substantially seal each housing screw hole 54. Finally, blade rod is substantially vacuum sealed between front blade support 84 and blade rod partition 76. Additional sealing is provided by rear blade rod support 88 and rear housing slot 79. It will be appreciated that sealing rings can be provided in the cutting housing to provide additional sealing.

Figure 5:
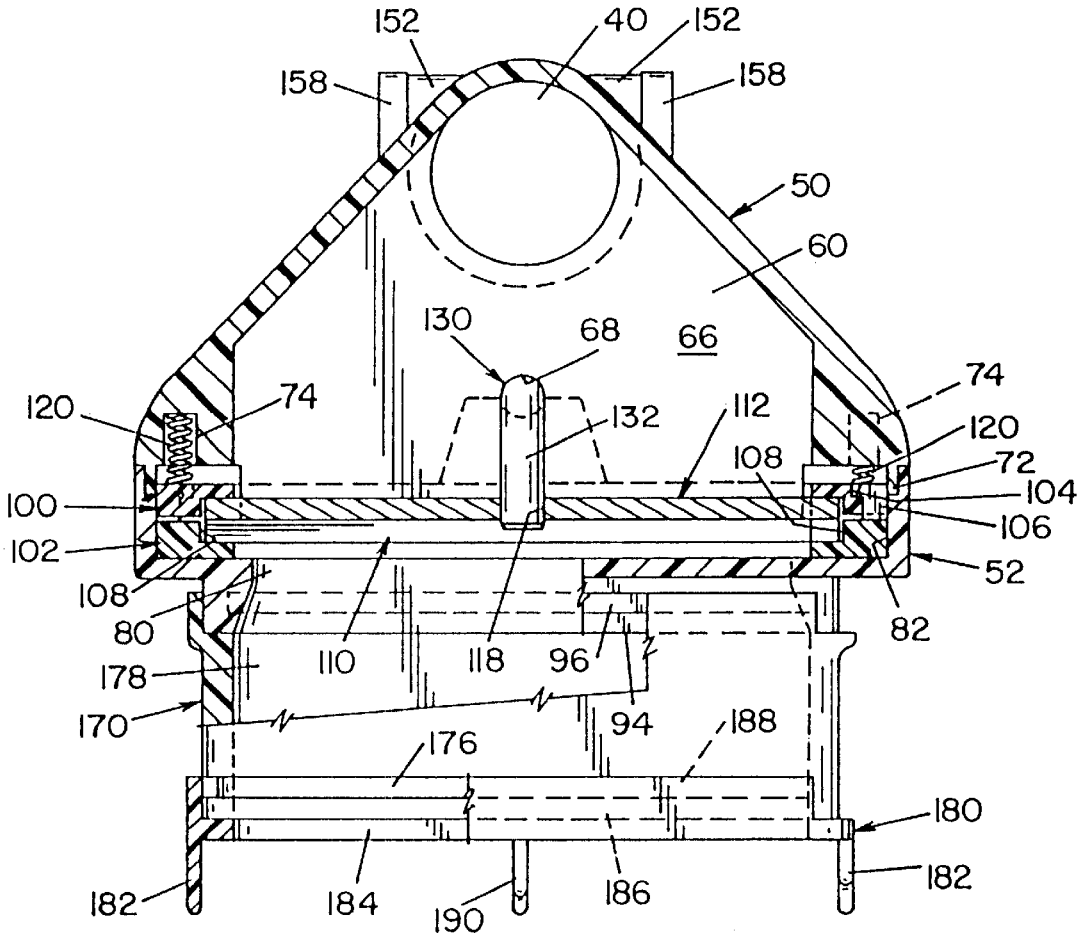
FIG. 5 is a cross-sectional view of the cutting device taken along line 5—5 of FIG. 4.

As illustrated in FIGS. 3, 5 and 6, a spacer 170 can be used to extend the distance of platform body 180 from base housing opening 80. The increase in spacing results in less hair being cut. As a result, an operator can select a specific spacer to cut an individual's hair at a desired length. As shown in FIG. 6, platform body 180 may be designed to cut hair at an angle and for cutting hair on different shaped heads and/or to produce various styles of haircuts. As can be appreciated, the rake ribs 190 help position the platform body 180 upon an individual's scalp and further direct the hair into the opening of the platform body.

Figure 12:
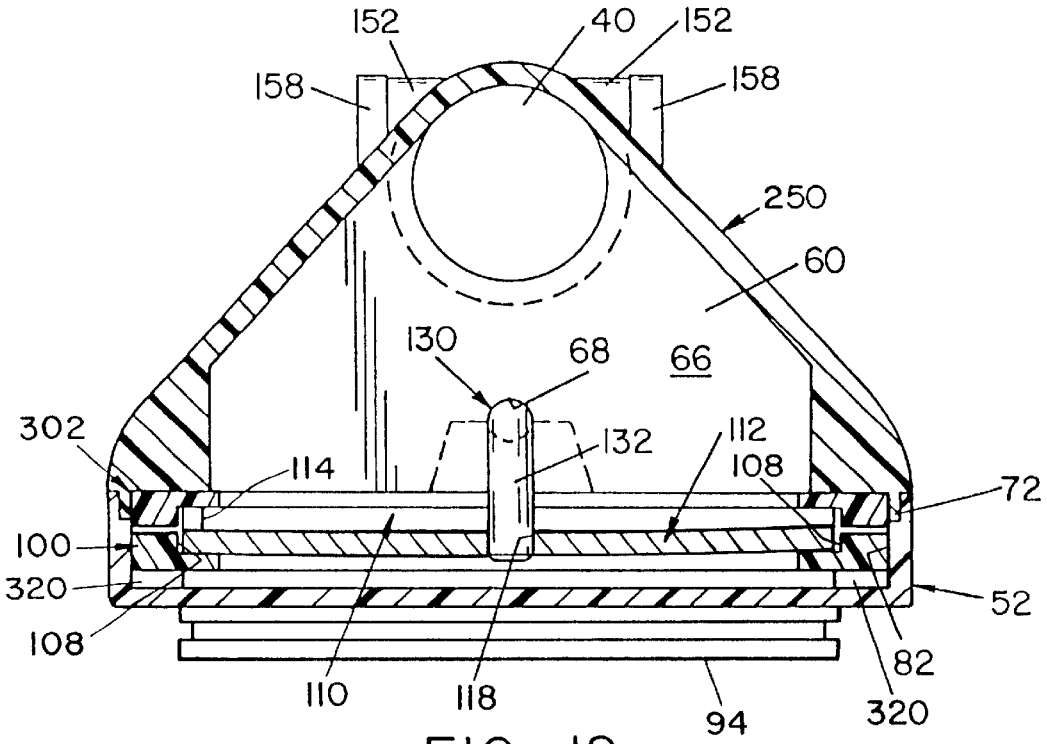
FIG. 12 is a cross-sectional view of the cutting device taken along line 12—12 of FIG. 10.
Figure 13:
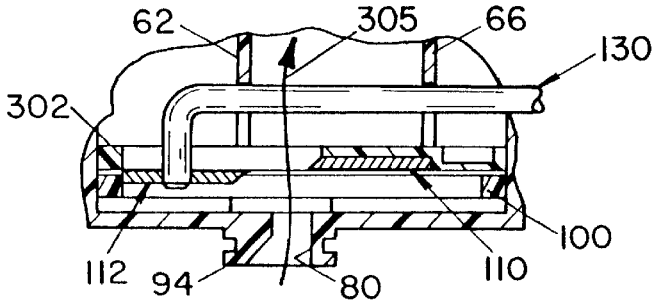
FIG. 13 is a partial cross-sectional view of FIG. 10 illustrating airflow through the cutting chamber when the blades are open.
Figure 14:
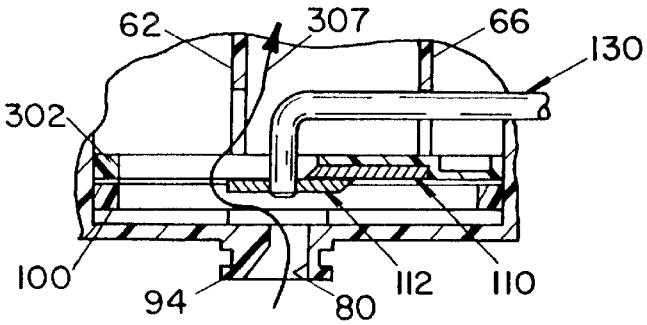
FIG. 14 is a partial cross-sectional view of FIG. 10 illustrating airflow through the cutting chamber when the blades are closed.
Figures 15, 16:
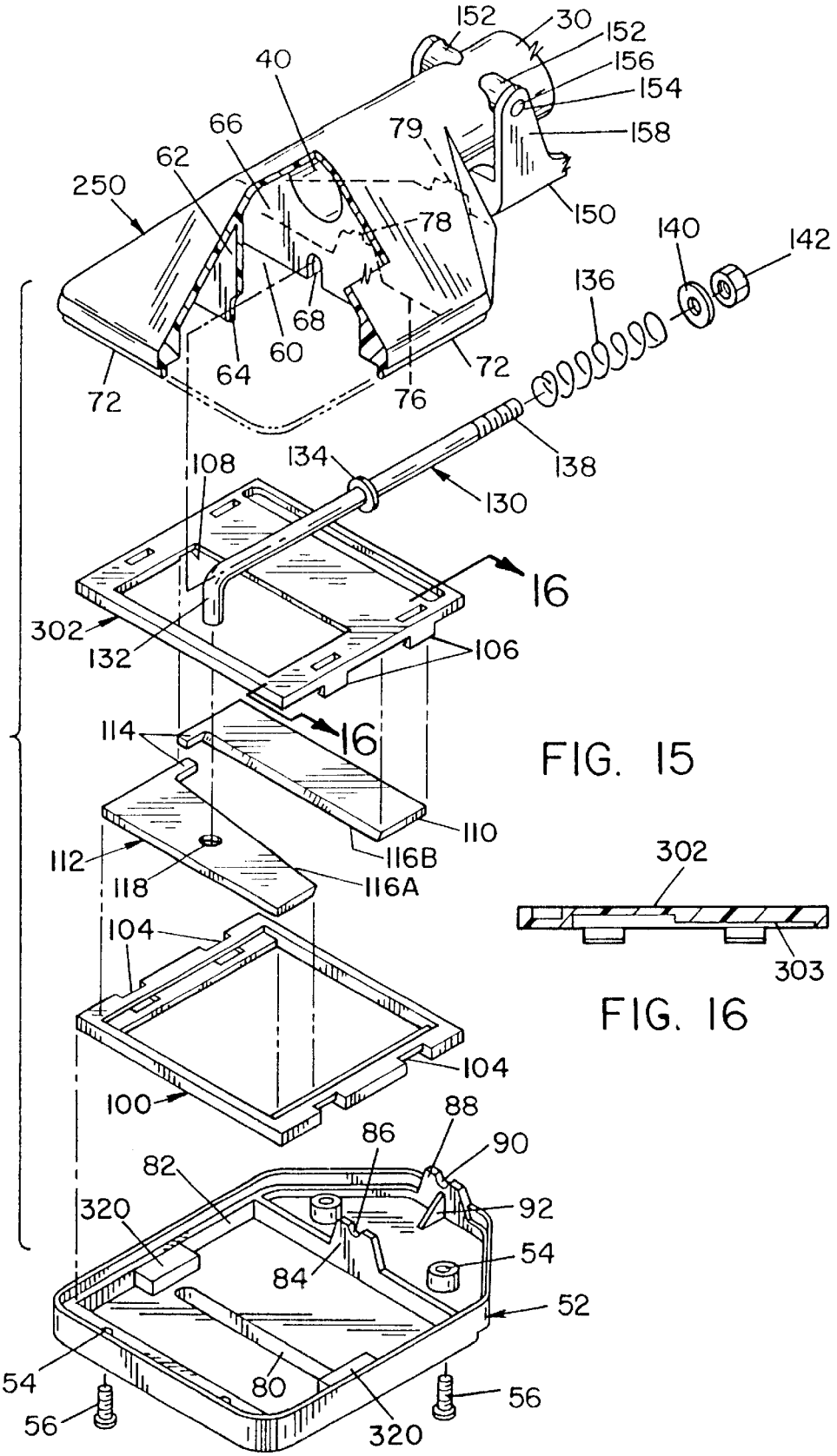
FIG. 15 is an exploded view of the cutting chamber and components positioned therein of FIG. 8.
FIG. 16 is a cross-sectional view taken along line 16—16 of FIG. 15.
Figure 17:
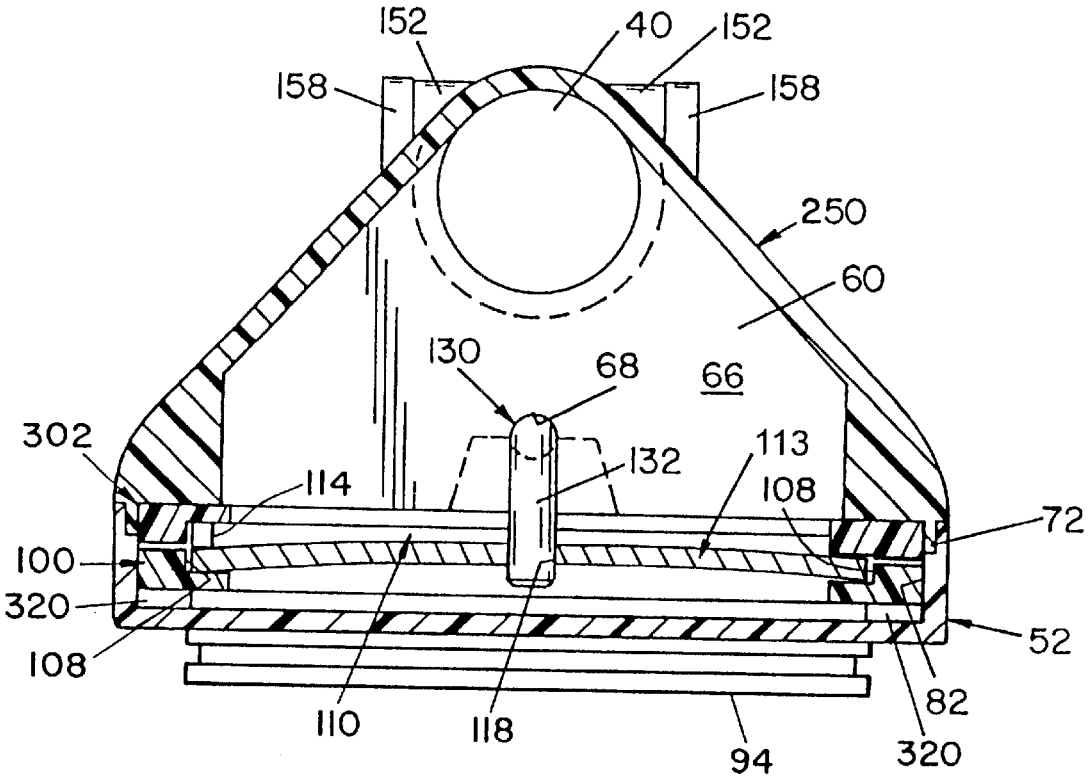
FIG. 17 is a cross-sectional view of another embodiment of the cutting device taken along a line identically situated as line 12—12 of FIG. 10.

Referring to FIGS. 8–16, a second embodiment is illustrated. As best seen in FIG. 15, the second embodiment operates in a manner similar to that of the first embodiment. However, the blade guide, which includes a set frame 302 and a pressure frame 100, is inverted, i.e. rotated 180° on the guide's longitudinal axis, as compared with the first embodiment. Also, the set blade 110, also known as the fixed blade, and the shear blade 112, also known as the moving blade, are inverted in the same manner. In addition, the springs 120 have been deleted and resilient pads 320 are instead used between the housing base 52 and the pressure frame 100 to apply pressure to the pressure frame. The pressure frame seats in the guide wall 82 over the resilient pads. This keeps the blades, which are operably confined within the blade guide (set frame 302 and the pressure frame 100), under yielding compression. Referring to FIGS. 12, 15 and 16 it can be seen that the shear blade 112 is slightly bowed, concavely in relation to set blade 110. This bow in the shear blade causes its narrow end, the end opposite the blade extension 114, to be raised above the set blade when the blades are in the open position as shown. This raised position of the shear blade's narrow end is accommodated in set frame 302 by elongated recess 303. The bowing serves to maintain a positive shearing action at a cutting point which moves along the length of the blades, from proximate their extensions 114 to the end of the blades, as the shear blade is pulled toward the set blade during cutting action of the device.

Referring to FIGS. 13 and 14, the cutting action of the blades is enhanced in this embodiment because the shear blade 112 is positioned on the inlet side of the set blade 110. This allows the force of the airflow, represented by the arrow 305, to push against the shear blade as the blade moves into the shear position, thus helping to keep the shear blade in positive shearing action with the fixed blade. When the shear blade is in the fully closed shear position there is no longer a gap between the blades for the airflow but airflow through the cutting chamber is not substantially interrupted because air can flow around behind the shear blade.

Referring to FIGS. 8–17, a third embodiment is illustrated. The third embodiment operates in a manner similar to that of the second embodiment disclosed in FIGS. 8–16. However, referring to FIG. 17, the shear blade 113 of the third embodiment is slightly bowed, convexly in relation to set blade 110. (The illustrated bow of 113 is very exaggerated for clarity of understanding.) For about a three-inch wide blade, the bow is such that the distance between the blade and a chord between the ends of the blade is preferably about 0.003 inches. When the blades are in the open position, as shown, the blades are contained in the blade guide, which includes a set frame 302 and a pressure frame 100. The blades' ends are controlled by the set frame and the pressure frame with the blades' extensions 114 overlapping, the shear blades' extension being disposed beneath (closer to the housing base 52 containing opening 80) the fixed blade's extension 114. Within the blade guide the set blade 110 is held in fixed position and the shear blade 113 is held so that it can move only in sliding, translational movement with respect to the set blade. In the open position, the shear blade 113 curves so that it is raised slightly at its center, proximate elbowed end 132 of the blade actuating rod 130, causing its cutting edge 116A to be curved above the straight cutting edge 116B of set blade 110. This bow in the shear blade serves to maintain a positive shearing action at a cutting point which moves along the length of the blades, from proximate their extensions 114 to the opposite end of the blades, as the shear blade is pulled toward the set blade during cutting action of the device. The bowing of the shear blade is accommodated by the elongated recess 303 defined in the side of set frame 302 opposite the blade extension 114. The shear blade 113 flexes slightly, tending to straighten, as its cutting edge engages and is pulled under the fixed blade's cutting edge, during the cutting action. With the blades' ends confined by the blade guide's set plate and pressure plate, the shear blade's bow assures that the blades' cutting edges maintain shearing contact during the cutting action.

The components of the haircutting device are preferably light weight, durable, corrosion-resistant materials such as aluminum, stainless steel, plastic, rubber, etc. As can be appreciated, additional housing designs may be used to accommodate the unique cutting components and arrangements of the present invention.

The present invention relates to a hair cutter, and more particularly, to a vacuum hair cutter which easily and effectively cuts hair; however, it can be appreciated that the concept of the vacuum cutter can be used to cut and dispose of many other types of materials.

The invention has been described with reference to a preferred embodiment and alternates thereof. It is believed that many modifications and alterations to the embodiments disclosed will readily suggest themselves to those skilled in the art upon reading and understanding the detailed description of the invention. It is intended to include all such modifications and alterations insofar as they come within the scope of the invention.

What is claimed is:

1. A device assisted by a vacuum source for cutting hair comprising:

(a) a housing defining a cutting chamber;

(b) an elongated housing member defining a channel for communication between the cutting chamber and the vacuum source, said member being grippable by a user's hand for holding and fully operating the device by said hand;

(c) an inlet slot, defined by the housing at a base of the cutting chamber and communicating with the cutting chamber, for ingress of ambient air and hair strands;

(d) means, when actuated, for cutting hair strands, the means for cutting being disposed within the cutting chamber directly above the inlet slot and in fixed relation to said slot;

(e) a lever pivotally affixed to the housing and disposed beneath the elongated member, the lever being operable by one or more fingers of said hand when the member is gripped by said hand, the lever being pivotable at one end over a range;

(f) a spring urging the lever to pivot to a first end of the range; and (g) means for coupling the lever through the housing to the means for cutting, the means for coupling actuating the means for cutting in response to the lever being pivoted toward a second end of the range.

2. The device according to claim 1 wherein the means for cutting comprises two opposing cutting edges, one edge being translationally slidable, in relation to the other edge, between an open position and a shear position, the edges shearing interposed hair strands as the edges close from the open position to the shear position.

3. The device according to claim 2 wherein the means for coupling the lever comprises means for linking the lever to one of the cutting edges, and wherein the other cutting edge is in fixed relation to the inlet slot, said means for linking moving its linked cutting edge between the open position and the shear position as the lever is pivoted from the first to the second end of the range.

4. The device according to claim 3 wherein the means for linking comprises a linear link coupled at one end to the translationally slidable cutting edge and at the other end to the pivot end of the lever.

5. The device according to claim 2 wherein at least one of the cutting edges is angled with respect to the other cutting edge to create a hair shearing point which moves along a line over the inlet slot as the cutting edges come together.

6. The device according to claim 5 wherein at least one of the cutting edges is resilient and bowed relative to the other cutting edge.

7. The device according to claim 5 wherein at least one of the cutting edges is resilient and convexly bowed relative to the other cutting edge.

8. The device according to claim 2 further comprising means for avoiding an interruption of airflow from the inlet slot into the cutting chamber when the cutting edges are in the shear position.

9. The device according to claim 3 wherein the cutting edges are defined on opposing margins of respective blades and the means for linking is coupled to one of the blades.

10. The device according to claim 9 further comprising means for allowing air to circumvent the blades when they are in the shear position.

11. The device according to claim 10 wherein the means for allowing air to circumvent comprises:

(a) a gap between the linked blade and the base of the cutting chamber, and (b) a space behind the linked blade that opens up as the linked blade slides toward the opposing blade.

12. The device according to claim 9 wherein at least one of the cutting edges is angled with respect to the other cutting edge to create a hair shearing point which moves along a line over the inlet slot as the cutting edges come together.

13. The device according to claim 12 wherein at least one of the blades is resilient and bowed relative to the other cutting edge.

14. The device according to claim 12 wherein at least one of the blades is resilient and convexly bowed relative to the other cutting edge.

15. The device according to claim 1 wherein the lever is longitudinally arcuate for better finger gripping.

16. The device according to claim 2 wherein the lever is longitudinally arcuate for better finger gripping.

17. The device according to claim 1 wherein the lever conforms to an adjacent underside of said elongated member.

18. The device according to claim 2 wherein the lever conforms to an adjacent underside of said elongated member.

* * * * *